US008499594B2

(12) United States Patent
Misner

(10) Patent No.: US 8,499,594 B2
(45) Date of Patent: Aug. 6, 2013

(54) ATTACK RESISTANT INSERTS FOR PADLOCKS, AND COMBINATION OPERATED PADLOCKS WITH ATTACK RESISTANT INSERTS

(75) Inventor: Michael O. Misner, Lake Villa, IL (US)

(73) Assignee: The Eastern Company, Wheeling, IL (US)

( * ) Notice: Subject to any disclaimer, the term of this patent is extended or adjusted under 35 U.S.C. 154(b) by 0 days.

(21) Appl. No.: 13/507,497

(22) Filed: Jul. 5, 2012

(65) Prior Publication Data

US 2013/0047681 A1 Feb. 28, 2013

Related U.S. Application Data

(63) Continuation-in-part of application No. 29/395,880, filed on Apr. 17, 2012, now Pat. No. Des. 672,632, which is a continuation-in-part of application No. 29/374,519, filed on Aug. 25, 2011, now Pat. No. Des. 662,396.

(60) Provisional application No. 61/575,637, filed on Aug. 25, 2011.

(51) Int. Cl.
*E05B 37/02* (2006.01)

(52) U.S. Cl.
USPC ..... 70/25; 70/26; 70/29; 70/51; 70/52; 70/322; 70/417

(58) Field of Classification Search
USPC ..... 70/20, 24–30, 51, 52, 312, 320–322, 70/417; D8/330, 331, 334, 343, 346, 349, D8/499
See application file for complete search history.

(56) References Cited

U.S. PATENT DOCUMENTS

| | | | | |
|---|---|---|---|---|
| 2,853,868 | A * | 9/1958 | Vahlstrom | 70/24 |
| 3,419,893 | A * | 12/1968 | Vahlstrom | 70/24 |
| 3,817,063 | A * | 6/1974 | Williams | 70/24 |
| 4,096,718 | A * | 6/1978 | Michelman et al. | 70/63 |
| 4,290,279 | A * | 9/1981 | Fish et al. | 70/38 A |
| 6,012,309 | A * | 1/2000 | Liu | 70/25 |
| 6,810,698 | B2 * | 11/2004 | Weinraub | 70/38 A |
| 7,536,883 | B1 * | 5/2009 | Liu | 70/25 |
| D662,396 | S * | 6/2012 | Misner | D8/343 |
| D672,632 | S * | 12/2012 | Misner | D8/343 |
| 2010/0192641 | A1 * | 8/2010 | Nave | 70/24 |

* cited by examiner

*Primary Examiner* — Lloyd Gall
(74) *Attorney, Agent, or Firm* — David A. Burge

(57) ABSTRACT

A combination operated padlock has indicia carrying dials that are turned to set a combination for unlocking a shackle of the padlock. Operating components of the padlock are carried by or within a housing-enclosed frame of the padlock. A strong, corrosion resistant insert, preferably formed from brass of uniform thickness, is configured to fit cleverly around and among the movable operating components to strengthen the padlock and to prevent operating component manipulation if an unauthorized unlocking of the padlock is attempted. In a preferred embodiment, the insert has two substantially identical question-mark-shaped tines configured to extend toward and between different adjacent pairs of the dials that are turned to set a combination.

20 Claims, 8 Drawing Sheets

ATTACK RESISTANT INSERTS FOR PADLOCKS, AND COMBINATION OPERATED PADLOCKS WITH ATTACK RESISTANT INSERTS

CROSS-REFERENCES

The present application claims the benefit of the Aug. 25, 2011 filing date of Provisional Application Ser. No. 61/575,637 filed by Michael O. Misner entitled INSERT FOR PADLOCK, AND PADLOCK CONSTRUCTION WITH ATTACK RESISTANT DIAL-TYPE CONTROL ASSEMBLY.

The present application is a continuation-in-part of Design Application Serial No. 29/395,880 filed Apr. 17, 2012 by Michael O. Misner entitled INSERT FOR PADLOCKS issued Jun. 26, 2012 as U.S. Pat. No. D-662,396, which was filed as a continuation-in-part of Design Application Serial No. 29/374,519 filed Aug. 25, 2011 by Michael O. Misner entitled INSERT FOR PADLOCKS.

The attention of the Office also is directed to U.S. Pat. No. 7,536,883 issued May 26, 2009 filed May 6, 2008 as Utility application Ser. No. 12/149,635 by Tien-Kao Liu entitled VANDAL-RESISTANT COMBINATION PADLOCK.

The disclosures of all of the above-identified patents and applications are incorporated herein by reference, in their entirety.

BACKGROUND

The present invention represents an improvement upon the subjects matter of the above-referenced U.S. Pat. No. 7,536,883 issued May 26, 2009 to Tien-Kao Liu entitled VANDAL-RESISTANT COMBINATION PADLOCK.

In particular, the present invention relates to strong, attack resistant, corrosion resistant inserts of novel configuration for use within combination operated padlocks, and to the use of inserts of novel configuration for strengthening and providing attack resistant and corrosion resistant improvements in padlocks of the type having a shackle that is released by turning indicia carrying wheels or dials to set a combination that permits a lever-like blocking member (or "rocking claw" as it is sometimes called) to pivot within an open area of a padlock's housing carried frame (i.e., within a so-called "frame defined space"). The dials extend into the frame defined space and interact with at least one operating component of the padlock that pivots within the frame defined space. In preferred practice the insert has two substantially identical question-mark-shaped tines that extend toward and between different adjacent pairs of the dials.

The referenced Liu patent discloses a chunky, cast zinc metal insert intended to inhabit and to substantially fill otherwise unused territory within a "frame defined space" of a combination operated padlock. The Liu insert is configured to closely embrace portions of an operating component that moves in a pivotal manner within the frame defined space. In essence, the insert of Liu is intended to extend so near to major portions of the movable operating component as to closely sandwich these portions in efforts to protect selected operating components of the padlock from damage due to an application of external force, or due to manipulation of operating components by using small tools inserted alongside dials of the padlock to defeat and open the padlock.

The present invention provides a much differently configured insert from that disclosed in the patent of Liu. Inserts embodying the preferred practice of the present invention are formed as brass stampings that are openly configured and designed to extend near to, without serving to closely sandwich, portions of the operating component that is supported by, and is pivotally movable within, the frame of a combination operated padlock.

In preferred practice, inserts that embody features of the present invention are formed from corrosion resistant brass, as stampings, and are designed to be of uniform thickness having a configuration that fits cleverly around and among operating components of the padlock to prevent the operating components from being manipulated to effect an unauthorized unlocking of the padlock. The insert preferably also serves to strengthen the padlock, thereby enhancing its resistance to forceful attack.

More particularly, the invention relates to improvements in dial operated combination padlocks that have evolved from padlocks of the type disclosed in U.S. Pat. Nos. 2,853,868 and 3,419,893 issued to Carl A. Valstrom, U.S. Pat. No. 3,817,063 issued to Merton S. Williams and, more recently, the referenced Liu patent. The Valstromm, Williams and Liu patents identified above are referred to later herein as the "Combination Padlock Patents." These and other patents disclose padlocks that utilize similarly configured frame supported subassemblies have shaft-supported dials which extend into so-called "frame defined spaces" wherein movable operating components known as "blocking members" pivot to selectively permit and prevent unlocking of U-shaped shackles of the padlocks in response to a turning of dials to set combinations that enable the blocking members to move in a way that causes the hardened steel shackles of the padlocks to unlock and open.

Although the aforementioned Williams patent discloses an improved padlock construction having a so-called "filler block" installed in a thin upper end region of a space defined by a frame of the padlock's control assembly, the Williams filler block is quite thin, is severely notched thereby weakening its strength at a central location, has a generally trapezoidal shape that extends into engagement with only small, spaced portions of the frame, and leaves open and unoccupied a sizable region or territory within the frame-defined space of the padlock—a space into which small tools and other foreign objects can be inserted if efforts are made to defeat the operation of the lock by manipulation, bending and/or breakage of components of the padlock—a space within which portions of the frame, dials, shaft, lever-like blocking member or other operating components can be deformed or displaced if subjected to external pressure or pounding in attempts to defeat the padlock by component breakage, deformation or displacement.

Although the presence of the thin, trapezoidal shaped filler block disclosed in the Williams patent does help to reinforce and rigidify an upper end region of the frame located a substantial distance from the dials and shaft that supports the dials, the remotely located filler block provides no direct support or reinforcement to the end region of the frame where the dials and the shaft are located, and does little to confine the lever-like blocking member or other components so they are permitted to move only within protected, permitted zones of movement.

Any benefit obtained by use of the Williams filler block can be lost if the filler block should crack, deform or break either as the result of its being severely centrally notched to accommodate blocking member movement, or due to its being provided with a sizable hole at the same central location as the notch—a hole into which a drive pin or threaded screw is forcibly driven at the conclusion of the padlock's assembly procedure to hold components of the padlock in assembled relationship.

Liu recognized that the small trapezoidal-shaped filler block of Williams could be improved upon, and that a significant amount of unoccupied territory within the frame defined space found in combination operated padlocks of the type disclosed in the Williams patent remains open and might be utilized disadvantageously during efforts to pry, pick, break or manipulate operating components of the padlock. Liu also recognized that the thin, trapezoidal-shaped filler block of Williams does nothing to directly support the dials or the shaft, or to confine movements of such components as the dials and the blocking member to restricted zones within which these components should be confined and permitted to move, or to prevent these components from being deformed or displaced to defeat operation of the padlock. Liu therefore provided a significantly larger filler block (which Liu referred to as a "claw mount") shown in FIG. 1 hereof, which is copied from FIG. 6 of the Liu patent.

SUMMARY

One aspect of the present invention resides in the provision of a strong, corrosion resistant insert of novel and open configuration designed to improve upon the attack resistant inserts proposed by Liu and others. Another aspect of the present invention resides in the provision of combination operated padlocks of enhanced corrosion and attack resistance that are strengthened by the inclusion of novel inserts that simplify the assembly of the padlocks during manufacture—padlocks that incorporate inserts which are strong, stiff and rigid to resist padlock deformation, that function nicely to withstand applications of manual force, and that resist the use of small tools and the like such as may be inserted through narrow openings adjacent the padlock's dials in an effort to manipulate and/or deform operating components during efforts to defeat and open the padlocks.

Unlike the corrodible die-cast zinc insert of Liu, inserts that embody the preferred practice of the present invention are preferably formed entirely of corrosion resistant brass. Inasmuch as most other major components of padlocks embodying the preferred practice of the present invention also are formed of corrosion resistant brass, padlocks that embody the preferred practice of the present invention provide a much greater resistance to corrosion than is provided by padlocks that employ the corrodible die-cast zinc insert of Liu.

Unlike the relatively massive, chunky and complexly configured, die-cast insert of Liu, inserts that embody the preferred practice of the present invention are preferably formed of stamped brass that is configured to provide a relatively open feel, extending only where needed to enhance strength and embellish the resulting padlock's resistance to attack. In preferred practice, the insert is formed as a one-piece stamping that is made by folding a single piece of brass plate stock that has first been cut to provide a shape which will yield an insert of desired configuration when folded during a stamping process.

Unlike the bulky die-cast zinc insert of Liu that sandwiches a pivotal blocking member so closely as to potentially cause problems if expansive corrosion should develop on the zinc metal insert itself, inserts that embody the preferred practice of the present invention reside primarily along only a front side of the pivotally movable blocking member, thereby avoiding problems caused by the Liu insert's narrow throat that effectively cuddles and provides a close front-and-rear sandwiching of major portions of the pivotal blocking member.

Unlike the complexly configured insert of Liu which requires manual insertion of a combination lock's pivotal blocking member into confines of a narrow throat of the insert before the insert itself must actually be installed as a subassembly in a frame-defined space of the padlock, the simple, openly configured insert that embodies the preferred practice of the present invention is designed to merely be dropped into the padlock's frame ahead of when the padlock's pivotally blocking member also is dropped into the frame—which very significantly simplifies the assembly of padlocks that include a corrosion and attack resistant insert. Nothing about the insert of the present invention slows or impedes the assembly of the improved padlock. Indeed, assembly of the padlocks that embody features of the present invention is thoughtfully designed to proceed quickly.

Whereas the insert of Liu has both thick and thin portions, and relies on thin left and right formations of cast metal received in notches of the padlock's frame to hold the insert of Liu in place within the frame of a combination operated padlock, inserts that embody the preferred practice of the present invention use folded brass material of a uniform thickness extending throughout the construction of the insert—which imposes no need for thin projections that must be inserted into notches of the padlock's frame to hold the insert in place.

Whereas the insert of Liu provides a narrow, downwardly opening throat that closely sandwiches both of the opposed front and rear sides of the blocking member that pivots back and forth within the Liu inserts narrow throat, inserts embodying the preferred practice of the present invention extend primarily along only a front side of two small but strong, question-mark-shaped tines that perform their duty by extending toward and between different adjacent pairs of the dials which are used to set a combination to unlock the padlock.

DESCRIPTION OF THE DRAWINGS

A fuller understanding of the present invention may be had by referring to the description and claims that follow, taken in conjunction with the accompanying drawings, wherein:

DETAILED DESCRIPTION

Figure 1:
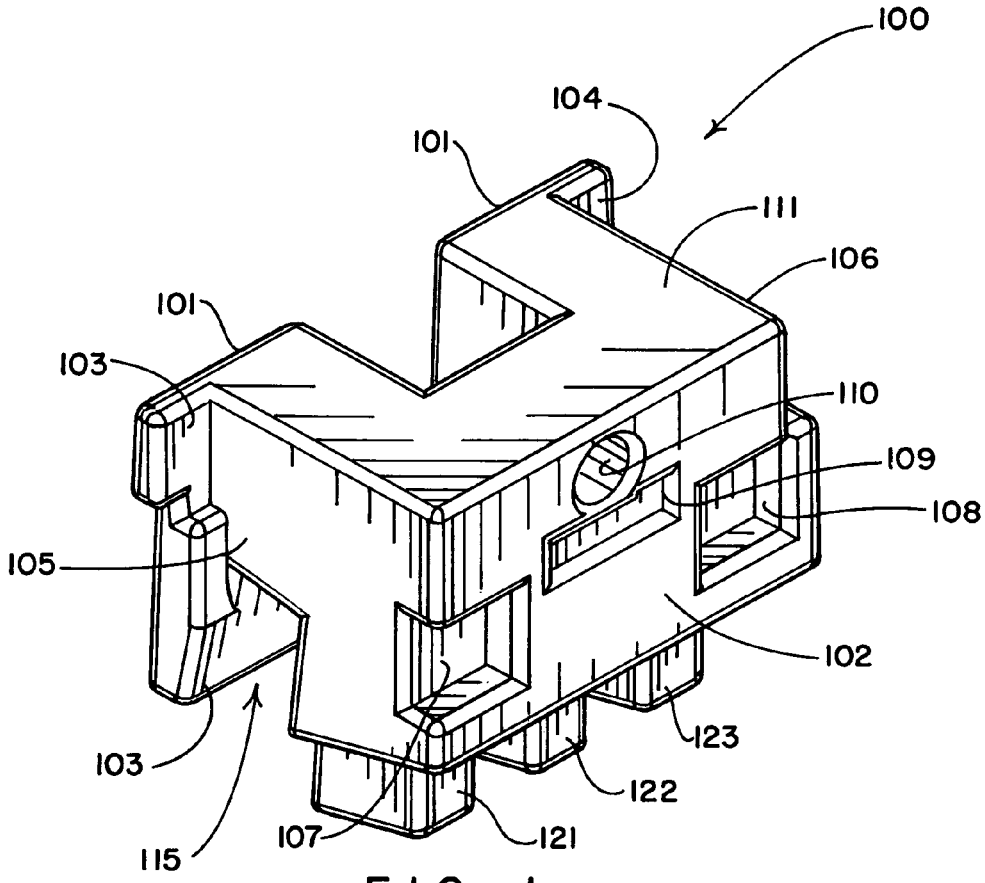
FIG. 1 PRIOR ART
FIG. 1 is perspective view of a PRIOR ART insert copied from FIG. 6 of the referenced Liu patent.
Figure 2:
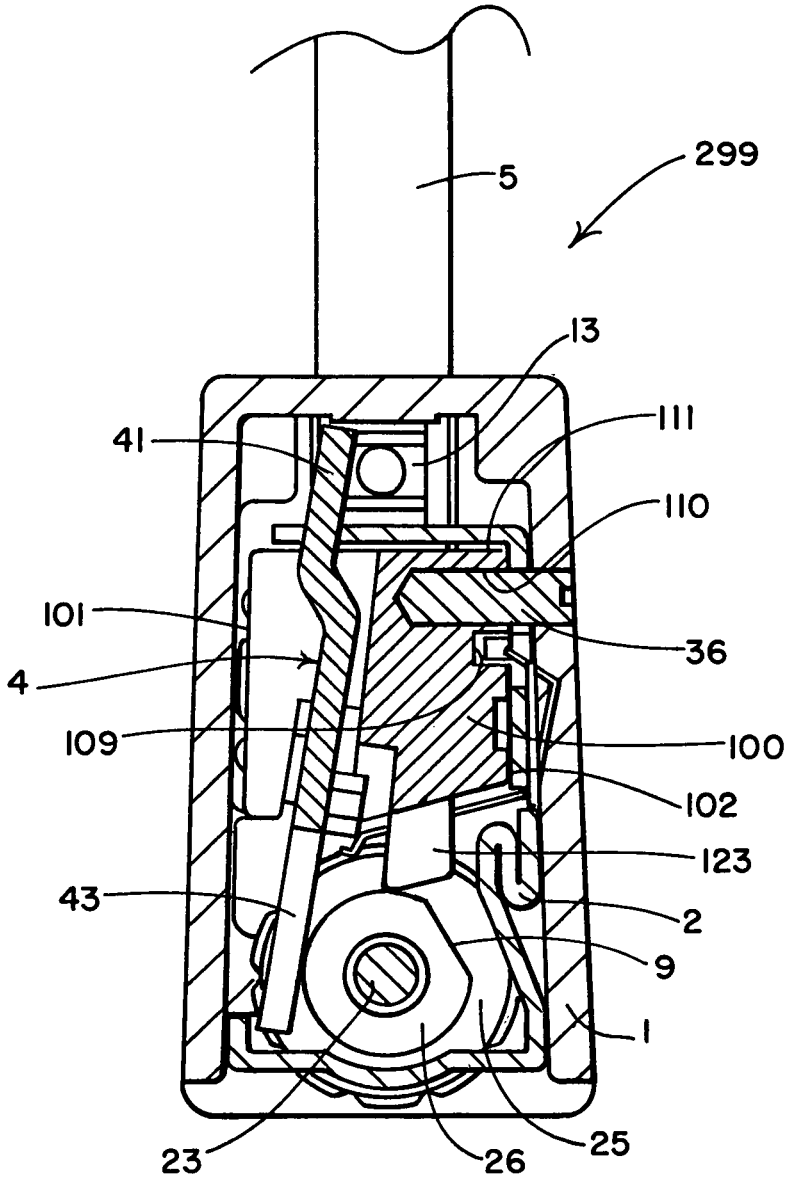
FIG. 2 PRIOR ART
FIG. 2 is a sectional view of a PRIOR ART padlock copied from FIG. 8 of the Liu patent.
Figure 6:
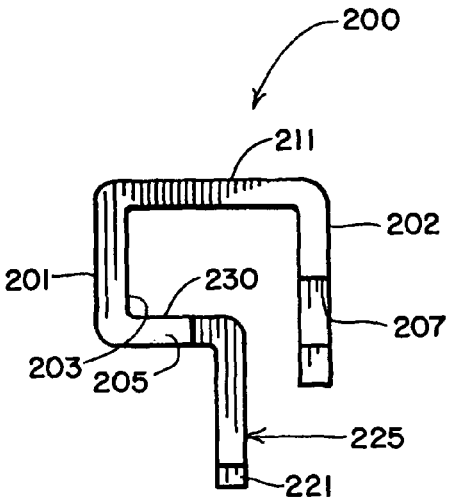
FIG. 6 is a side view thereof showing what can be thought of as the "question-mark-shape" of one of the two identical tines of the insert, it being understood that an opposite side view is a mirror image hereof.
Figure 8:
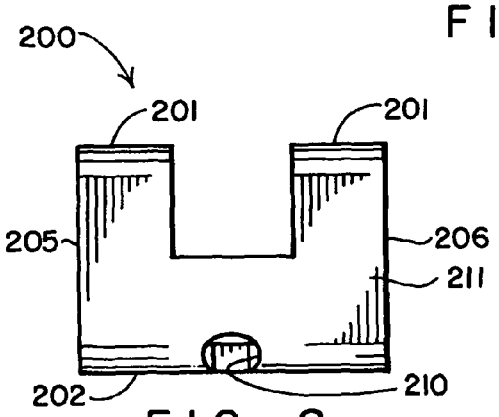
FIG. 8 is a top view thereof.
Figure 9:
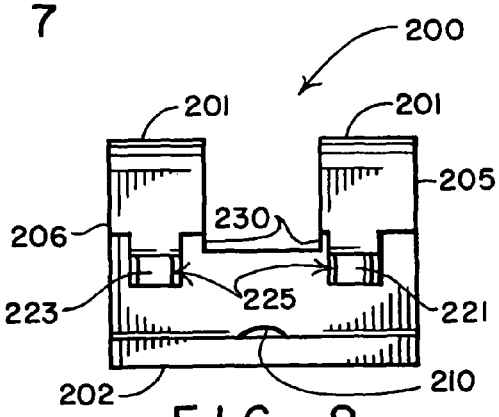
FIG. 9 is a bottom view thereof.
Figure 10:
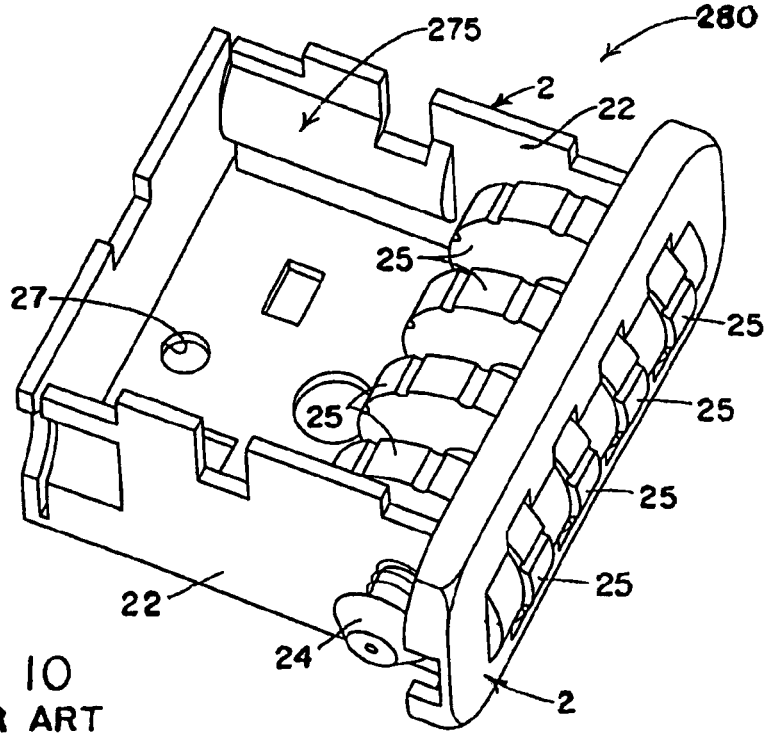
FIG. 10 PRIOR ART
FIG. 10 is a PRIOR ART perspective view on an enlarged scale showing a conventional open frame sub-assembly such as is widely used in combination padlocks including both the Liu padlock and combination operated padlocks that embody the preferred practice of the present invention, with the view illustrating an lidless boxlike configuration of a frame employed by the assembly.

In overview, the enlarged scale depiction provided by FIG. 1 shows what will be referred to herein as the Liu insert 100, which also is shown on an enlarged scale in FIG. 6 of the referenced Liu patent. The sectional view provided by FIG. 2 shows what will be referred to as the Liu padlock 299, which also is shown in cross-section in FIG. 8 of the Liu patent. The enlarged scale perspective view provided by FIG. 10 shows a conventional frame-carried sub-assembly 280 of the type that is employed not only by padlocks of the Liu type, but also by padlocks that embody the preferred practice of the present invention. How the conventional sub-assembly of FIG. 10 is formed is adequately described in the Liu patent, which is incorporated herein by reference.

Referring to FIG. 1 hereof, the Liu insert 100 has opposed, spaced, parallel-extending, substantially flat, front and rear surface portions 101, 102, respectively. The substantially flat front surface 101 has thin leftwardly extending and rightwardly extending projections 103, 104, respectively. As the Liu patent explains, the thin projections 103, 104 of the Liu insert 100 are inserted into notches 21 of a frame 2 (FIG. 10) of the Liu padlock 299 to hold the Liu insert 100 in place in the frame 2.

Referring still to FIG. 1, the Liu insert 100 has a U-shaped top surface 111 that extends from the left and right portions of the front surface 101 to the rear surface 102. Substantially flat left and right side walls 105, 106, respectively, of the Liu insert 100 extend from portions of the leftwardly and rightwardly extending projections 103, 104 to portions of the substantially flat rear surface 102.

Referring still to FIG. 1, the rear surface 102 of the Liu insert 100 is interrupted by three substantially rectangular, rearward opening recesses 107, 108, 109, and by a centrally located, rearwardly opening hole 110. As is explained in the Liu patent, the recesses 107, 108, 109 are configured to loosely receive therein formations of non-movable components of the Liu padlock—so that the Liu insert 100 in no way obstructs how other components fit together or function. In effect, the insert 100 of Liu mainly serves to substantially fill otherwise unused, unoccupied territory within the frame defined space 275 (FIG. 10) within the conventional frame-supported sub-assembly 280 (FIG. 10) of the Liu padlock 299 that is shown in FIG. 2.

Figure 5:
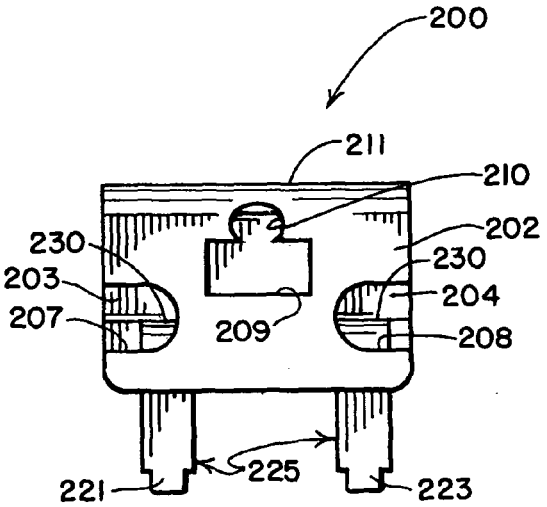
FIG. 5 is a rear view of the novel brass insert of the present invention.

As can be seen in FIG. 2 hereof, the hole 110 permits passage therethrough of a pin or threaded fastener 36 (see also FIGS. 5 and 8 of the Liu patent) which clamps the rear wall 102 of the Liu insert 100 against the frame 2 when the frame 2 is fastened by the pin or threaded fastener 36 to the outer body 1 of the Liu padlock 299.

Figure 7:
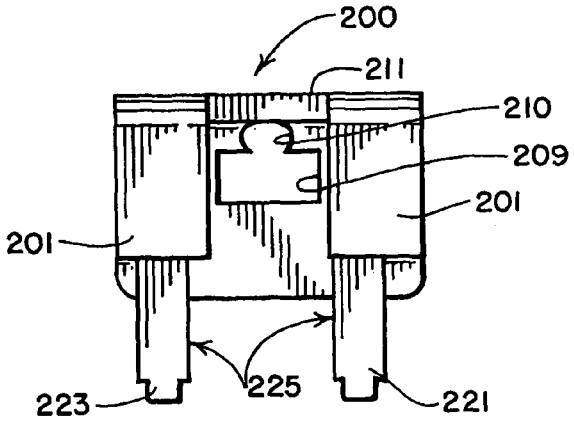
FIG. 7 is a front view thereof.

Referring again to FIG. 1 hereof, the Liu insert 100 is a meaty chunk of die-cast zinc metal, much of the heft of which is defined by a solid central portion of the Liu insert 100 that extends between the opposed left and right side walls 105, 106, and that forms the U-shaped top wall 111. This hefty "meat" of the Liu insert 100 cooperates with the oppositely projecting, thin portions 103, 104 to define a relatively narrow, downwardly opening throat 115, within which portions of a lever-like blocking member 4 (see FIGS. 2 and 12 hereof, and FIGS. 5, 7 of the Liu patent) execute a limited pivotal movement to selectively permit and prevent unlocking and opening of a shackle 5 (see FIG. 2 hereof, and FIGS. 5, 7, 8 of the Liu patent) of the Liu padlock 299 shown in FIG. 2.

Figure 12:
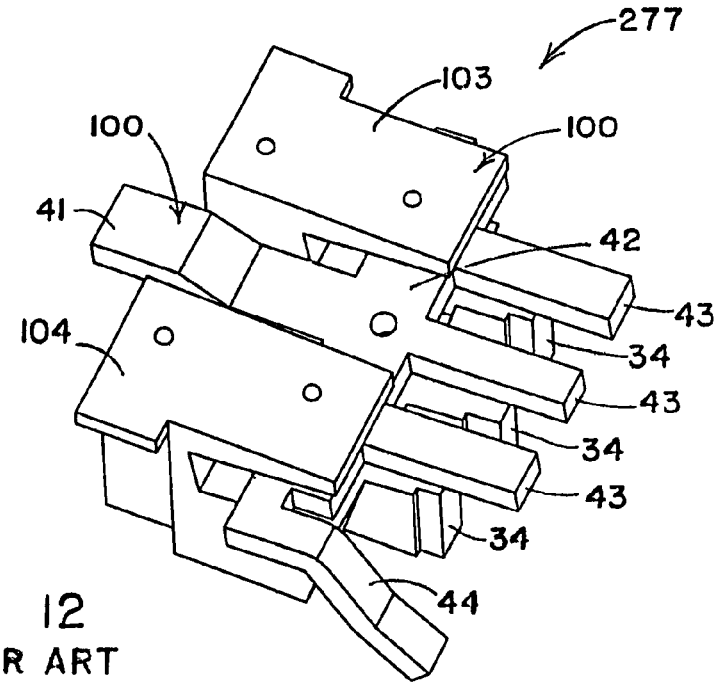
FIG. 12 PRIOR ART
FIG. 12 is a PRIOR ART perspective view of a sub-assembly of the Liu insert with a conventional blocking member installed in a narrow throat of the Liu insert.

Referring again to FIG. 1, extending along a rear side of the narrow, downwardly opening throat 115 (within which the blocking member 4 pivots back and forth) are the depending left and right projections 103, 104; and, extending along a front side of the narrow throat 115 are three small, depending, finger-like tines 121, 122, 123. How portions of the blocking member 4 is positioned within the narrow throat 115 of the Liu insert 100 to form a sub-assembly 277 during assembly of the Liu padlock 299 of FIG. 2 is shown in FIG. 12.

The depending tines 121, 122, 123 of the Liu insert 100 are configured to extend toward and between adjacent pairs of the indicia-carrying dials 25 that may be turned about a supporting shaft 23 to set a combination that will unlock the Liu padlock as by positioning flats (one of which is indicated by a reference numeral 9 in FIG. 2) to permit a depending finger 43 of the blocking member 4 to pivot in a counterclockwise direction (as viewed in FIG. 2) to unlock the shackle 5 of the Liu padlock (as is explained more fully in the Liu patent).

Because the downwardly opening throat 115 of the Liu insert 100 is narrow, and because the Liu insert 100 is formed from die-cast zinc (not from a more costly corrosion resistant metal such as brass), corrosion within the narrow throat 115 that inhibits proper pivotal movement of the blocking member 4 is a concern. Moreover, if small tools are inserted into the narrow interior throat 115 of the Liu insert 100, such tools may become jammed in the narrow throat 115, thereby inhibiting or debilitating proper operation of the Liu padlock.

The finger-like tines 121, 122, 123 are configured to extend into small spaces between the indicia-carrying dials 25. The close fit of the tines 121, 122, 123 and the dials 25, and the fact that the tines 121, 122, 123 and other portions of the Liu insert 100 are made from corrodible die-cast zinc metal (which is can enlarge in the presence of corrosion) also raises the concern that corrosion may impede and detract from proper operation of relatively movable operating components of the Liu padlock 299 shown in FIG. 2 hereof. Other components of the Liu padlock 299 are indicated by the same two digit numerals as are used in the drawings of the Liu patent—except for the Liu insert, which is consistently indicated throughout the present document by the numeral 100.

Figure 3:
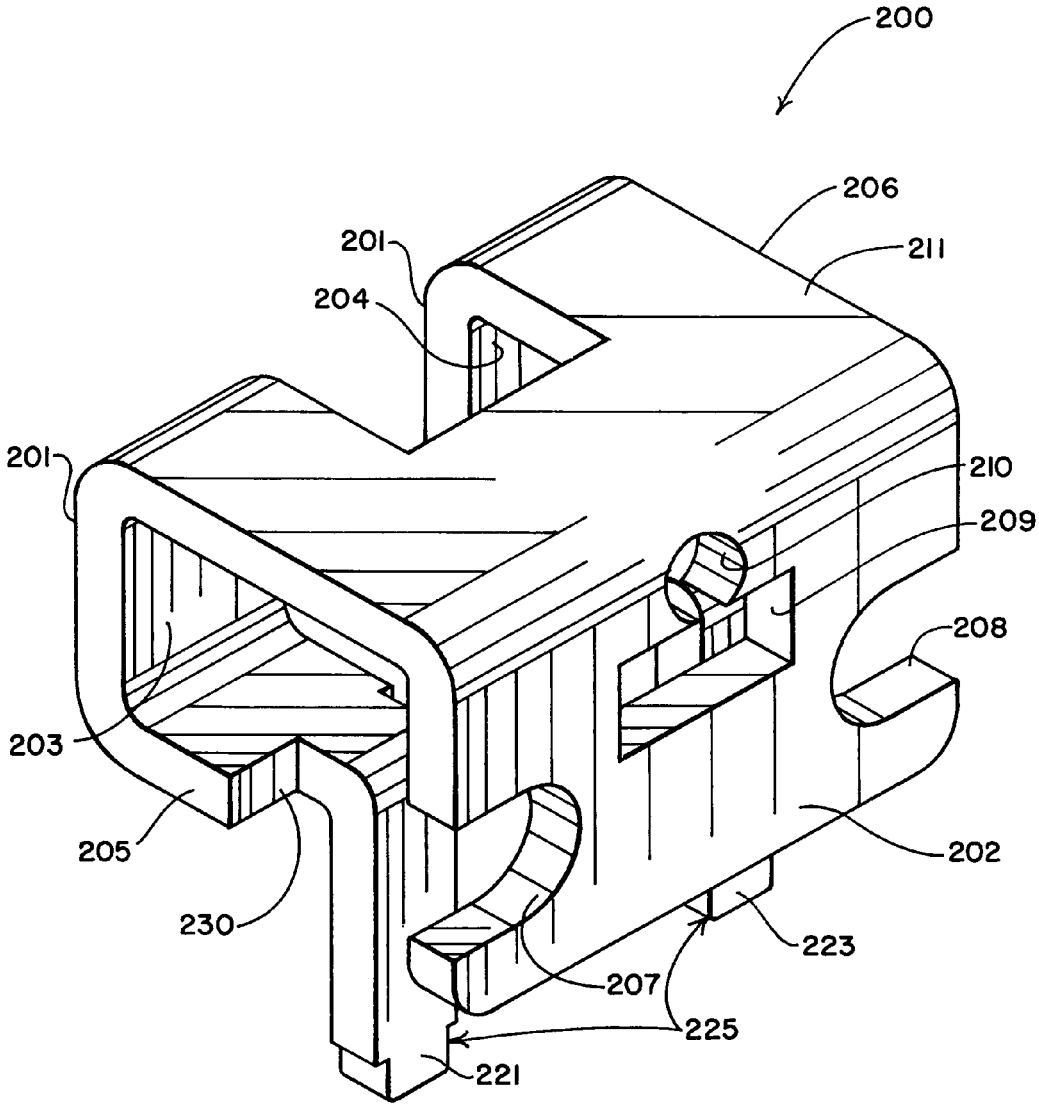
FIG. 3 is a perspective view, resembling FIG. 1, of a brass insert of novel configuration embodying features of the present invention.
Figure 4:
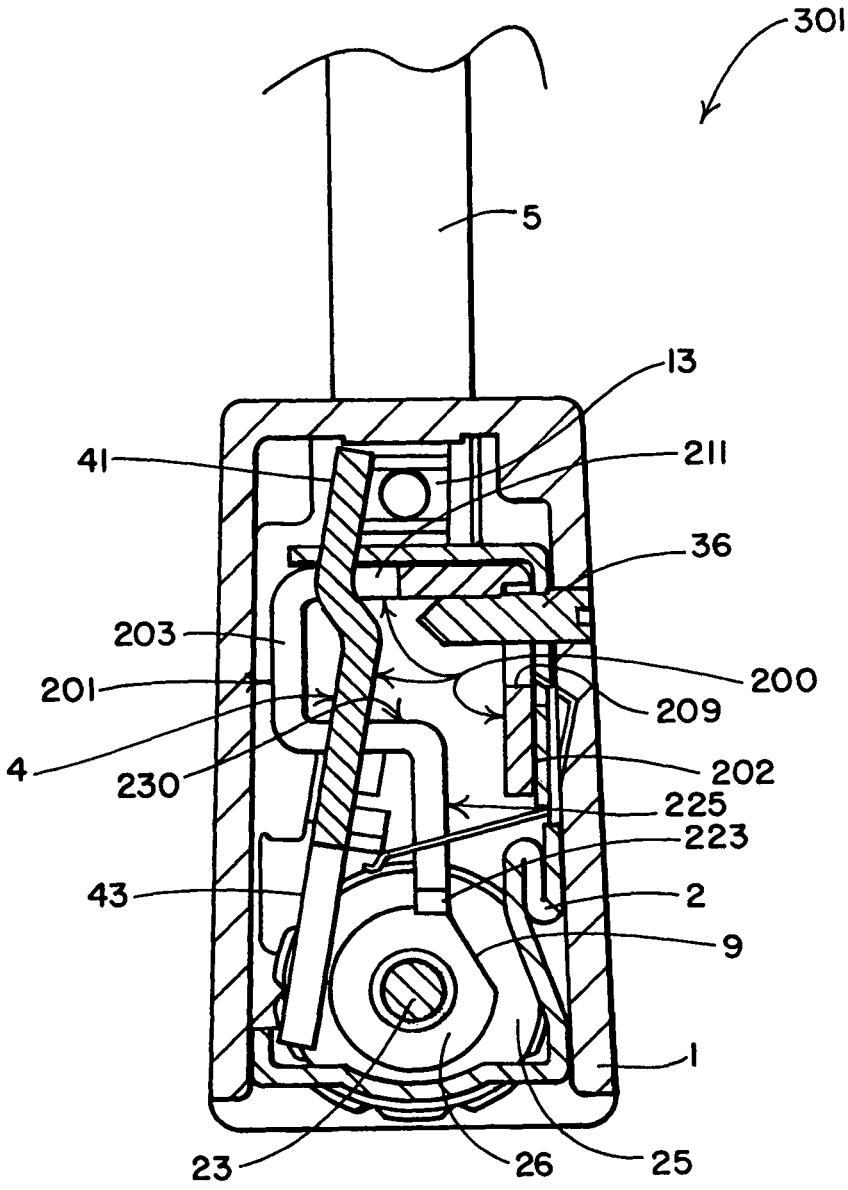
FIG. 4 is a sectional view that resembles FIG. 2 but shows a combination operated padlock having the novel brass insert of the present invention installed therein.

Components of the improved padlock 301 shown in FIG. 4 that are identical in configuration and operation to components of the Liu padlock 299 are indicated by the same numerals as are used in the Liu patent. This use of identical numerals renders the Liu patent's explanation of the nature and operation of its components pertinent to the improved padlock 301 inasmuch as the improved padlock 301 and the padlock 299 of Liu are identical in all respects, with the exception that, in the improved padlock 301, a much improved, corrosion resistant stamped brass insert 200 shown in FIGS. 3-9 hereof is used to replace the corrodible die-cast zinc insert 100 of Liu.

Because the Liu insert 100 utilizes its narrow throat 115 to so closely surround or sandwich the blocking member 4, it is not possible to assemble the Liu padlock 299 by simply separately dropping the Liu insert 100 and the blocking member 4, in sequence, into the relatively wide frame-defined space 275 (FIG. 10) that remains open after other components of the Liu padlock 299 (FIG. 2) are put in place within the box-like frame 2 (FIG. 10) of the Liu padlock 299. Rather, it is necessary to halt the assembly of the Liu padlock 299 to create a separate sub-assembly 277 such as is shown in FIG. 12, by inserting portions of the blocking member 4 into the narrow throat 115 of the Liu insert 100.

Figure 13:
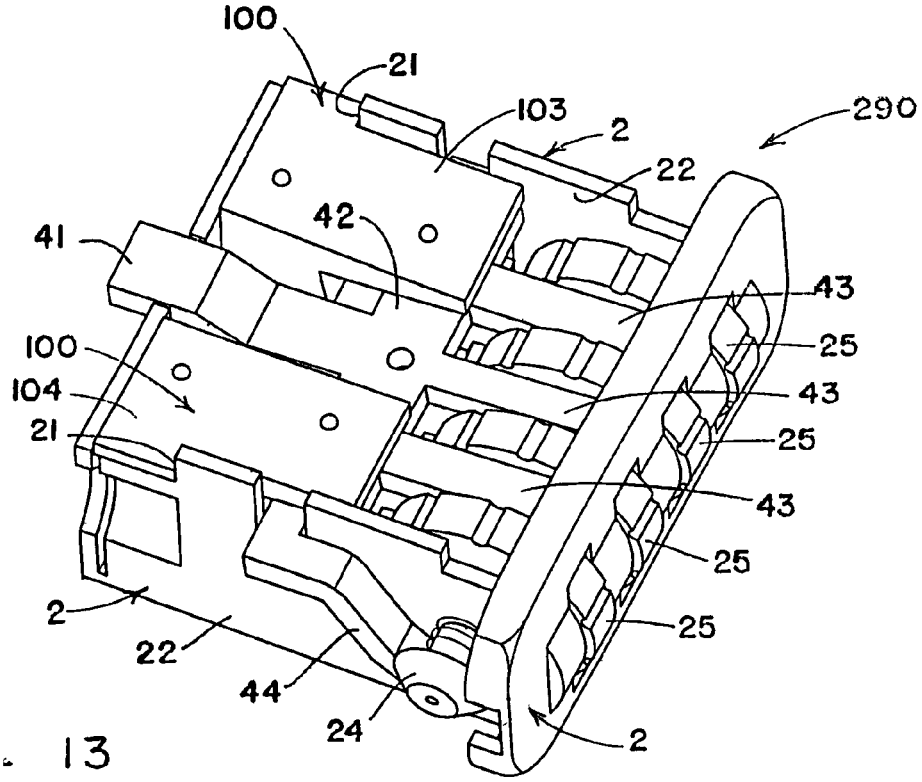
FIG. 13 PRIOR ART
FIG. 13 is a PRIOR ART perspective view of a combination of the sub-assemblies of FIG. 10 and FIG. 12—a combination that is employed by padlocks embodying features of the Liu type.

Because the elements of the sub-assembly 277 shown in FIG. 12 tend to fall apart (rather than to remain assembled as shown in FIG. 12), the sub-assembly 277 must be carefully, manually held together as it is inserted into the open space 275 of the frame supported sub-assembly 280. Insertion of the sub-assembly 277 into the frame-supported sub-assembly 280 is a bit tricky, is a bit complicated, and is time consuming because the sub-assembly 277 must not only be tipped forwardly but also must be tilted sideways in order to extend and properly position a forwardly- and downwardly-projecting arm 44 (FIG. 10) of the blocking member 4 beneath and behind a the enlarged head of a small collar 24 (FIG. 13) carried on an end of the dial support shaft 23. The extra time and care that must be taken during these added assembly steps significantly slows the efforts by those who are employed to manually assemble and check the proper functioning of the Liu padlock 299.

Referring to FIG. 4, an improved corrosion and attack resistant padlock embodying features of the present invention is indicated generally by the numeral 301. The improved padlock 301 is identical in all respects to the Liu padlock 299 (shown in FIG. 2 hereof) except for the corrosion and attack resistant insert 200 (shown in FIG. 3 hereof) that replaces the Liu insert 100 (shown in FIG. 1 hereof, and in FIG. 8 of the Liu patent).

Referring to FIG. 3, the insert 200 can be fabricated in a variety of ways—preferably by a stamping process that folds a cut-out piece of brass of uniform thickness, or by casting molten brass to form a structure such as is depicted in FIG. 3 which has integrally formed portions that may be hardened after fabrication.

Referring to FIG. 3 and to FIGS. 5-9, the insert 200 has front and rear portions that define opposed, spaced, parallel extending, substantially flat, front and rear surfaces 201, 202, respectively, that are connected by a integral top portion that defines a U-shaped top surface 211. The substantially flat front surface 201 has spaced left and right surface areas or regions that are defined by spaced left and right front parts 203, 204, respectively. Substantially flat, opposed left and right side surfaces 205, 206 extend from the left and right front portions 203, 204 that define the front wall 201, to a rear portion of the insert 200 that defines the substantially flat rear surface 202.

Referring to FIGS. 3, 4 and 6, two small but strong tines 225 of substantially a "question-mark-shape" (though without the "period" portion of a question mark) are defined by a sequence of formations of the insert 200 including portions of the horizontally extending top surface 211, the vertically depending wall formations 203 and 204 defining surfaces 201, the transversely extending horizontal tine formations 230, and lower end regions 221 and 223. The "question-mark-shape" of the two identically configured tines 225 can be observed in the right side view of FIG. 6 (and could be even more clearly seen in a mirror image reversal of FIG. 6 which would depict the insert 200 as viewed from its left side). The "question-mark-shape" of the one of the tines 225 that includes the lower end region 221 can be best observed in FIG. 3.

Referring still to FIG. 3, the rear surface 202 of the insert 200 is interrupted by two rounded, cut-out regions 207, 208, by a generally rectangular opening 209, and by a hole 210 located along the top of the rectangular opening 209. The cut-out regions 207, 208 and the opening 209 function similarly to the recesses 107, 108 and 109 of the Liu insert 100 to relatively loosely receive therein formations of non-movable elements of the assembled padlock 301, so the insert 200 in no way obstructs how other components of the padlock 301 fit together or function. The hole 210 receives a threaded screw 36 (see FIG. 4 hereof) to clamp the rear wall 202 of the insert 200 against the frame 2 (see FIG. 4 hereof) in much the same way that a pin or threaded fastener 36 clamps the rear wall 102 of the insert 100 against the frame 2 in the Liu padlock 299, shown in FIG. 2 hereof.

Whereas much of its heft and "meat" of the Liu insert 100 was provided by a solid expanse of die-cast zinc that substantially filled otherwise unused and unoccupied territory within a frame-defined space 275 (FIG. 10) of the conventional frame supported sub-assembly 280 that is shown in FIG. 10, the insert 200 of the present invention (FIG. 3) is a much more open structure that diminishes the overall weight of a padlock 301 in which the insert 200 is installed. The insert 200 leaves open a substantial amount of the unused and unoccupied territory within the frame-defined space 275 by providing insert formations that extend only where needed to strengthen the padlock 301 and/or to block the insertion of narrow tools into the space 275, should an effort be made to manipulate or deform operating components of the padlock 301.

Whereas the Liu insert 100 defines a narrow, downwardly opening throat 115 that sandwiches portions of the blocking member 4 between the insert's front and rear portions, the insert 200 of the present invention has the pair of elongate tine formations 230 that extend horizontally (as depicted in FIGS. 4 and 6) which cooperate with the left and right front portions 203, 204 to block tool access to the finger-like portions 43 of the blocking member 4 to resist manipulation and deformation of the blocking member 4 and operating components of the frame-supported assembly 280.

The two depending tines 225 of the insert 200 that extend beside the finger-like portions 43 of the blocking member 4 have lower end regions 221, 223 of diminished size. The two depending tines 225 extend toward and extend between different adjacent pairs of the indicia carrying dials 25 to stiffly and securely support the shaft 23 on which the dials 25 are carried, thereby rendering operating components (e.g., the shaft 23, the dials 25 and the blocking member 4) of the padlock 301 resistant to deformation by hammering and to other external forces that may be imposed on the padlock 301 in an effort to defeat its operation.

Referring to FIG. 10, the conventional frame-supported sub-assembly 280 is built on a frame 2 that also is utilized in the Liu padlock 299. The frame 2 (shown most clearly in the exploded view provided by FIG. 5 of the Liu patent) has a shape somewhat like an lidless box, through which the shaft 23 extends, on which the dials 25 (and several other components shown in the exploded view) are mounted, and about which the dials 25 are turnable.

Figure 14:
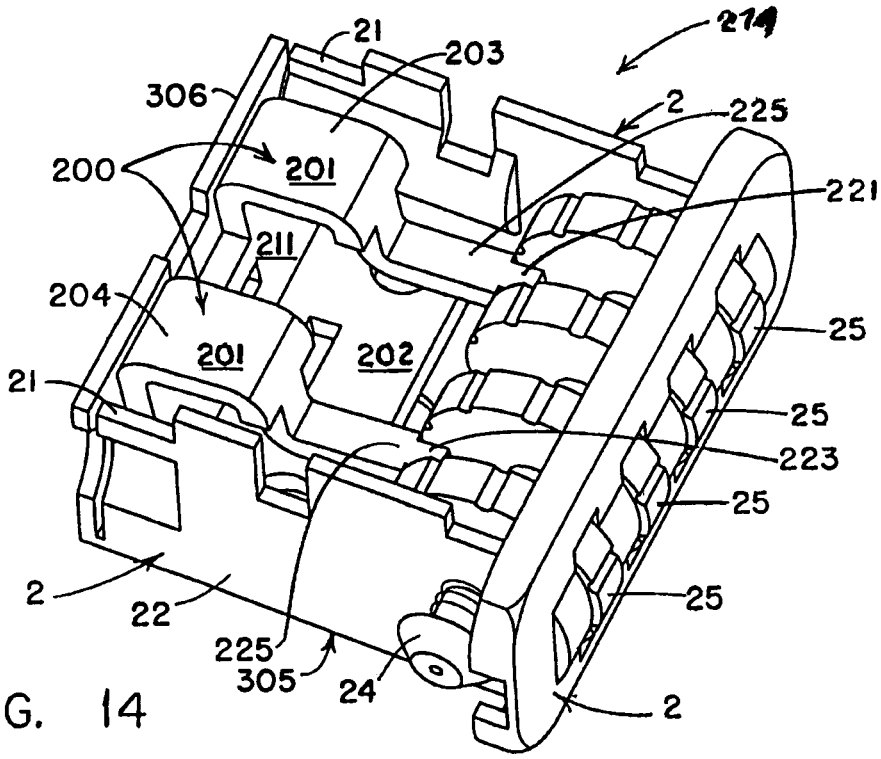
FIG. 14 is a perspective view showing a novel insert embodying features of the present invention dropped into the conventional sub-assembly of FIG. 10; and, FIG. 15 is a perspective view showing the sub-assembly of FIG. 12 having a novel brass insert embodying features of the present invention installed therein.
Figure 15:
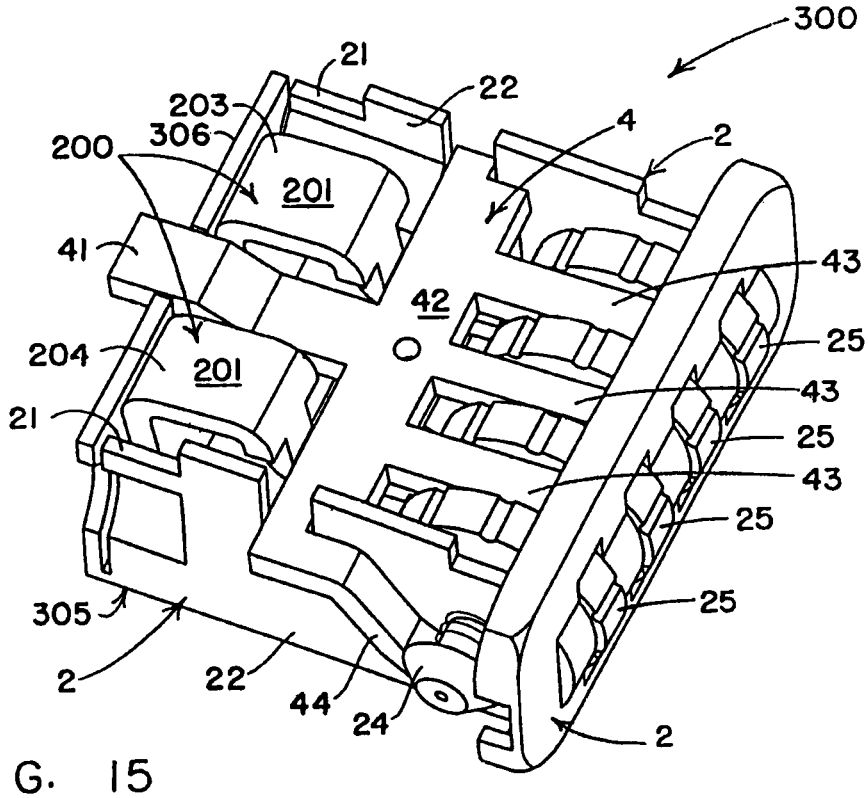

Referring to FIGS. 14 and 15, the most sizable wall of the box-like frame 2 is a generally rectangular wall 305 located at the base of the "box" (which Liu refers to as a "front wall" of the frame 2). A generally rectangular wall 306 is at the opposite end of the frame 2 from the wall through which the dials 25 extend. A feature of the insert 200 shown in FIG. 4 is that the insert 200 has two relatively sizable walls 202 and 211 that, when positioned in the frame-supported assembly 280 of FIG. 10, reside closely along the perpendicularly extending walls 305, 306 of the frame 2, thereby strengthening the frame 2.

How the improved padlock 301 shown in FIG. 4 operates is identical to how the Liu padlock 299 shown in FIG. 2 operates, and hence need not be explained in detail herein inasmuch as the Liu patent is incorporated herein by reference. In brief, turning the indicia-bearing dials 25 to set a correct combination unlocks the shackle 5 so it can open. When the dials 25 are otherwise turned to not set a correct combination, the shackle 5 can be closed, and will remain in a closed, locked position until a correct combination is again set to unlock the shackle 5. As is also explained in the Liu patent, the correct combination used to unlock the Liu padlock 299 can be changed, when desired—and the same explanation is applicable to the padlock 301.

Recognized by the present invention is the fact that, in order to ensure that operating components of padlocks employing conventional sub-assemblies 280 such as is depicted in FIG. 10 need not have their frame defined space 275 substantially filled by a massive chunk of die cast corrodible metal such as is provided by the Liu insert 100. Recognized by the present invention is that, in order to ensure that operating components of the padlock are properly supported and kept from being deformed or defeated by external force or inserted picks and other small tools, a strong but relatively open, corrosion and attack resistant insert 200 such as is depicted in FIG. 3 serves nicely and provides the resulting padlock 301 with improved features.

Also recognized and put to use by the present invention is the fact that the shaft-mounted dials 25 (which are rotated to set the combination of a combination operated padlock) can be very adequately supported and kept in their required proper operational positions by using only two relatively small sized, corrosion-resistant brass tines 225 of question-mark-shape that are partly defined by from front wall formations 203, 204, providing a uniquely configured, open center insert formed of corrosion resistant brass, rather than by three corrodible wedge-shaped tines that depend from a back wall of a much more massive die-cast corrodible zinc metal insert such as is provided by Liu.

What the present invention further recognizes and utilizes is the fact that sandwiching a pivotally movable blocking member 4 between closely overlying front and rear walls of a relatively massive die-cast zinc metal insert member 100 is not necessary to the proper operation of the lever-like blocking member 4 when an open-center, corrosion resistant brass insert 200 of simpler configuration can offer very adequate deformation-resistant support and resistance to attack—an insert that significantly simplifies the assembly of the padlock by making it entirely unnecessary to stop the assembly of the padlock to form a sub-assembly of the blocking member 4 combined with the insert 100 that must be carefully inserted into the open area of a frame of a combination-operated padlock, as is required during assembly of the Liu padlock 299.

Figure 11:
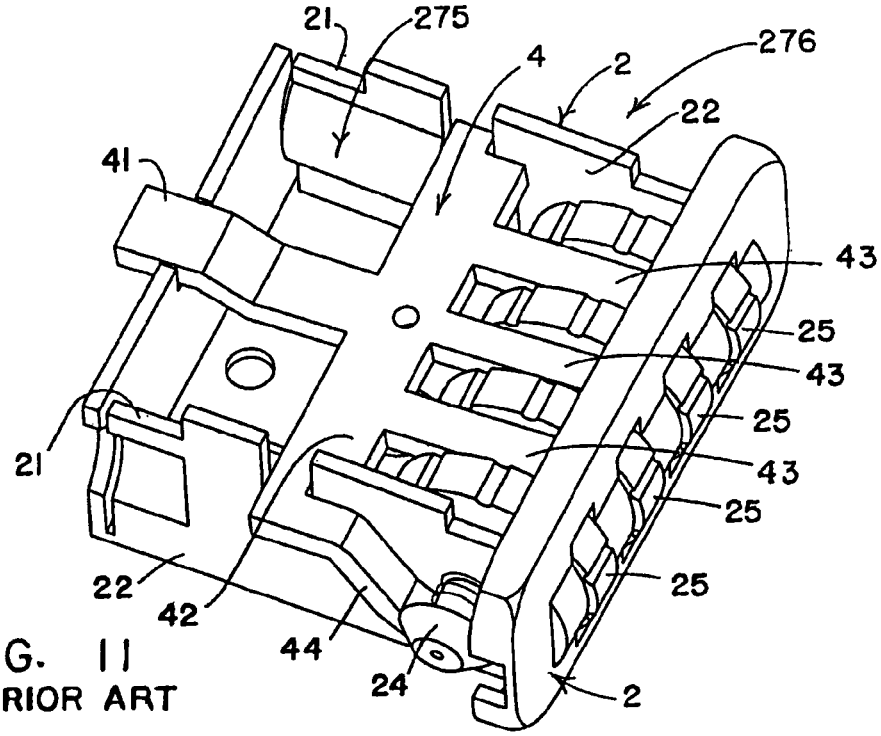
FIG. 11 PRIOR ART
FIG. 11 is a PRIOR ART perspective view showing a conventional pivotal blocking member dropped into the conventional open frame sub-assembly of FIG. 10.

Interestingly, padlocks of the type addressed by the referenced "Combination Padlock Patents" can be made to function properly if the conventional frame-supported subassembly 280 shown in FIG. 10 is simply enhanced by adding to it the blocking member 4, to form a sub-assembly 276 such as is shown in FIG. 11 prior to insertion of the sub-assembly 276 of FIG. 11 into the outer body or housing 1 shown in FIGS. 2 and 4 (if the fastener 36 is given something to seat into, such as the trapezoidal shaped filler block shown in the referenced Williams patent). The addition of the inserts 100, 200 to the padlocks 299, 301, respectively, does nothing to affect normal operation of the padlocks 299, 301, for the inserts 100, 200 only occupy territory within the frame defined space 275 (FIG. 10) that normally is neither occupied by nor put to use by operating components of the padlocks 299, 301. The inserts 100, 200 are intended to provide enhanced strength and attack resistance to the padlocks 299, 301. However, as has been explained, the novel and improved insert 200 performs these functions nicely while also providing the padlock 301 with valuable enhancements such as improved corrosion resistance.

In assembling the padlock 299 disclosed in the Liu patent, operating components are first assembled to provide a conventional frame-supported subassembly 280 such as is depicted in FIG. 10. The blocking member 4 is then inserted into the narrow throat 115 of the Liu insert 100, to provide a sub-assembly 277 such as is shown in FIG. 12. The sub-assembly 277 is then inserted into the conventional frame-supported sub-assembly 280 of FIG. 10 to form the sub-assembly 290 shown in FIG. 13. Once the sub-assembly 290 is formed, it is then inserted into the housing or outer body 1 depicted in FIG. 2, and the fastener 36 is put in place to hold together the assembled components of the completed padlock 299 of Liu.

In contradistinction, assembling the improved padlock 301 shown in FIG. 4 does not require the formation of a separate sub-assembly such as is indicated in FIG. 12 by the numeral 277. Instead, once the conventional sub-assembly 280 shown in FIG. 10 has been provided, the novel brass insert 200 is merely dropped into the open space 275 (FIG. 10) of the sub-assembly 280, to form the sub-assembly 274 shown in FIG. 14. The blocking member 4 then is tipped so the projecting arm 44 can descend beneath the collar 24, and the blocking member 4 is dropped into the sub-assembly 274 of FIG. 14 to form the sub-assembly 300 shown in FIG. 15. The fastener 36 is then put in place to hold together the assembled components of the completed padlock 301.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty that exist in the invention disclosed.

What is claimed is:

1. A combination operated padlock comprising a plurality of indicia-carrying dials that are turnable on a shaft to set a combination that unlocks a metal shackle from a metal housing of the padlock, with the padlock having a stamped metal frame protectively enclosed by the housing and supporting the shaft, having a blocking member movable within the frame to unlock the shackle in response to setting a correct combination by turning the dials, and having a one-piece stamped metal insert carried within the frame that defines two substantially question-mark-shaped tines, a portion of each of which projects toward and extends between a different pair of the plurality of dials.

2. The combination padlock of claim 1 wherein the stamped metal insert has portions configured to extend relatively near to while avoiding engagement with components of the padlock.

3. The combination padlock of claim 1 wherein the one-piece stamped metal insert is formed from an elongate sheet of corrosion resistant metal of substantially uniform thickness.

4. The combination padlock of claim 1 wherein the stamped metal frame has the configuration of a lidless box, and the one-piece stamped metal insert is configured to extend closely along two adjacent, substantially perpendicularly extending walls of the lidless box thereby strengthening the frame.

5. The combination padlock of claim 1 additionally including a single elongate fastener extending through aligned holes in the housing and the frame and into the stamped metal insert.

6. A combination operated padlock comprising a metal housing, a generally U-shaped metal shackle lockable to and unlockable from the housing, with a metal frame of generally lidless-boxlike configuration shrouded by the housing, with movable operating components carried by the frame including four shaft-supported indicia carrying dials that can be turned to set a combination that will unlock the shackle from the housing, and with a one-piece stamped metal insert carried within the frame that is configured to extend closely along two adjacent, substantially perpendicularly extending walls of the frame, and having two substantially identical question-mark-shaped tines, a portion of each of which projects toward and extends between a different adjacent pair of the four dials.

7. The combination padlock of claim 6 wherein the stamped metal insert has portions configured to extend relatively near to while avoiding engagement with all movable operating components of the padlock.

8. The combination padlock of claim 6 wherein the one-piece stamped metal insert is formed from an elongate piece of brass of substantially uniform thickness.

9. The combination padlock of claim 6 additionally including a single elongate fastener extending through aligned holes in the housing and the frame and into the stamped metal insert.

10. The combination padlock of claim 6 wherein the insert has a configuration requiring that, during assembly of the padlock, the insert must be positioned within the frame before an operating component consisting of a blocking member having fingers configured to extend between different adjacent pairs of the dials can be positioned within the frame, whereafter the frame is inserted into and affixed to the housing.

11. A padlock having a one-piece metal frame housed by a case and having a shackle latched to the case until a blocking member of the padlock movable within a frame-defined space releases the shackle for movement relative to the case in response to a combination being set by turning four indicia carrying dials on a frame-carried shaft, and having a one-piece insert formed by folding an elongate piece of brass of uniform thickness installed in the frame-defined space, with the insert having two identical substantially question-mark-shaped tines a portion of each of which extends between different adjacent pairs of the dials.

12. The combination padlock of claim 11 wherein the one-piece insert has portions configured to extend relatively near to while avoiding engagement with all movable operating components of the padlock, including the blocking member, the four indicia carrying dials and the frame-carried shaft.

13. The combination padlock of claim 11 wherein the metal frame is formed as a stamping having the configuration of a lidless box, and the metal insert is configured to extend closely along two adjacent, substantially perpendicularly extending walls of the lidless box thereby strengthening the frame.

14. The combination padlock of claim 11 additionally including a single elongate fastener extending through aligned holes in the case and the frame and into the insert.

15. A one-piece insert configured to fit into a space defined by a housing-shrouded box-like frame of a padlock that is unlocked by turning four shaft-carried dials to set a combination, wherein the insert is formed from brass of substantially uniform thickness and configured to extend closely about, without engaging, operating components of the padlock that are movable within the frame, with the configuration of the insert including two substantially identical question-mark-shaped tines, a portion of each of which is extensible toward and between different adjacent pairs of the four dials.

16. The insert of claim 15 additionally including a single elongate fastener for extending through aligned holes in the housing and the frame and into the insert.

17. A one-piece attack resistant insert positionable within a housing-shrouded box-like frame-defined space of a combination operated padlock having four indicia-bearing dials that are turnable on a frame-supported shaft to set a combination that will unlock a shackle from the housing of the padlock, with the insert being formed from brass of substantially uniform thickness, having two substantially flat, substantially perpendicularly extending walls of the substantially uniform thickness configured to extend closely along two substantially perpendicularly extending walls of the frame, and having two substantially question-mark-shaped tines, portions of each of which are configured to extend toward and between different adjacent pairs of the four dials.

18. The insert of claim 17 wherein the insert has portions configured to extend relatively near to while avoiding engagement with all movable operating components of the padlock, including the four indicia-bearing dials and the frame-supported shaft.

19. The insert of claim 17 wherein the frame is formed as a metal stamping having a lidless box shape, and the metal insert has a configuration requiring that, during assembly of the padlock, the insert must be positioned within the frame before an operating component consisting of a blocking member having fingers shaped to extend between different adjacent pairs of the dials can be positioned within the frame.

20. The insert of claim 17 additionally including a single elongate fastener for extending through aligned holes in the housing and the frame and into the insert.

* * * * *